US011403991B2

(12) United States Patent
Wang et al.

(10) Patent No.: US 11,403,991 B2
(45) Date of Patent: Aug. 2, 2022

(54) DISPLAY PANEL AND SPLICED DISPLAY PANEL

(71) Applicant: TCL CHINA STAR OPTOELECTRONICS TECHNOLOGY CO., LTD., Guangdong (CN)

(72) Inventors: Tianhong Wang, Guangdong (CN); Yunxiao Zhong, Guangdong (CN); Ilgon Kim, Guangdong (CN)

(73) Assignee: TCL CHINA STAR OPTOELECTRONICS TECHNOLOGY CO., LTD., Guangdong (CN)

( * ) Notice: Subject to any disclaimer, the term of this patent is extended or adjusted under 35 U.S.C. 154(b) by 0 days.

(21) Appl. No.: 15/734,614

(22) PCT Filed: Sep. 25, 2020

(86) PCT No.: PCT/CN2020/117725

§ 371 (c)(1),
(2) Date: Dec. 3, 2020

(87) PCT Pub. No.: WO2022/047863

PCT Pub. Date: Mar. 10, 2022

(65) Prior Publication Data

US 2022/0068191 A1 Mar. 3, 2022

(30) Foreign Application Priority Data

Sep. 3, 2020 (CN) ..... 202010913445.4

(51) Int. Cl.
*G09G 3/20* (2006.01)

(52) U.S. Cl.
CPC ... *G09G 3/2096* (2013.01); *G09G 2300/0408* (2013.01); *G09G 2300/0426* (2013.01)

(58) Field of Classification Search
CPC ..... G09G 3/2096; G09G 2300/0408; G09G 2300/0426
See application file for complete search history.

(56) References Cited

U.S. PATENT DOCUMENTS

| | | | | |
|---|---|---|---|---|
| 2016/0343292 | A1* | 11/2016 | Zheng | G06F 1/3265 |
| 2018/0108604 | A1 | 4/2018 | Chen et al. | |
| 2018/0211609 | A1* | 7/2018 | Wang | G02F 1/136227 |
| 2018/0364537 | A1 | 12/2018 | Huang et al. | |
| 2019/0139477 | A1* | 5/2019 | Chen | G09G 3/20 |
| 2021/0183327 | A1* | 6/2021 | Chen | G09G 3/20 |
| 2021/0341662 | A1* | 11/2021 | Zhang | G02B 6/002 |

FOREIGN PATENT DOCUMENTS

| | | | |
|---|---|---|---|
| CN | 105513498 | A | 4/2016 |
| CN | 107179639 | A | 9/2017 |
| CN | 110109301 | A | 8/2019 |
| CN | 209765229 | U | 12/2019 |
| CN | 110928009 | A | 3/2020 |
| CN | 111540297 | A | 8/2020 |

* cited by examiner

*Primary Examiner* — Towfiq Elahi
(74) *Attorney, Agent, or Firm* — Mark M. Friedman

(57) ABSTRACT

A display panel and a spliced display panel are provided. The display panel includes a GOA circuit, a GOA signal bus, and a chip-on-film area. The present invention changes a traditional way that signal outputs from both sides of the chip-on-film area to a way that signal outputs from each thin-film chip, so as to reduce signal difference in wiring of a GOA bus.

8 Claims, 4 Drawing Sheets

DISPLAY PANEL AND SPLICED DISPLAY PANEL

FIELD OF INVENTION

The present invention relates to the field of display technology, in particular to a display panel with an ultra-narrow border and a spliced display panel.

BACKGROUND OF INVENTION

In response to market demand, large-sized, high-resolution, and ultra-narrow border (UNB) displays have become a trend. In recent years, spliced screens have received widespread attention from the market, which put forward a demand for display products with ultra-narrow border technology. Since splicing seams are reduced to the greatest extent, a distance requirement of less than 1 mm between adjacent spliced panels has become a trend. Meanwhile, three-narrow-one-wide products in which a GOA circuit is disposed on one side of the panel (GOA in source) have attracted widespread attention in the industry in recent years because they can be used for three-side splicing and have a price advantage that cannot be overlooked compared to current products.

Technical Problem

As shown in FIG. 1, in the current GOA-in-source technology, two sides of an entire chip-on-film area 12 are provided with connecting wires connecting a GOA signal bus 11. A large-area cross of the GOA signal bus 11 and a data wire of a GOA circuit area will cause delays (RC loading) in the GOA signal bus 11. Access points near-end A and far-end B of the GOA signal bus 11 have a non-negligible difference (refer to FIG. 2 for specific waveform difference), which causes more difference in waveform delay of a GOA signal received by the GOA circuit in different regions, and further causes pixels in a display area to be poorly charged.

Therefore, it is necessary to provide a display panel with an ultra-narrow border to improve the problems in the prior art.

SUMMARY OF INVENTION

One objective of the present invention is to provide a display panel to reduce the difference between the near end and the far end of the GOA signal bus access point.

The present invention provides a display panel, including a main display area and a non-display area; the non-display area including one wide-area and three narrow-areas, the wide-area and the narrow-area surround the main display area, and a border width of the wide-area is greater than a border width of the narrow-area. In the non-display area, the display panel further including: a GOA circuit disposed in the wide-area and close to the main display area; a GOA signal bus disposed in the wide-area in parallel with the GOA circuit and connected to the GOA circuit; a chip-on-film area disposed in the wide-area in parallel with the GOA signal bus, and the GOA signal bus disposed between the GOA circuit and the chip-on-film area; wherein, the chip-on-film area includes a plurality of thin-film chips arranged in an array, each of the thin-film chips is provided with at least one output terminal, the GOA signal bus is provided with at least one input terminal corresponding to each of the thin film chips, and the output terminal and the input terminal are connected by a metal wiring.

Further, the output terminal includes a first output terminal and a second output terminal, the first output terminal and the second output terminal are respectively disposed on both sides of the thin film chip, the input terminal includes a first input terminal and a second input terminal corresponding to the first output terminal and the second output terminal; and the first output terminal and the second output terminal are respectively connected to the first input terminal and the second input terminal through the metal wiring.

Further, the metal wiring includes a plurality of first signal wirings arranged in parallel; the GOA signal bus includes a plurality of second signal wirings arranged in parallel, and the second signal wirings are parallel to the first signal wirings; and the first signal wiring is connected to its corresponding second signal wiring through connecting wiring, and the connecting wiring is perpendicular to the second signal wiring.

Further, in the non-display area, the display panel includes: a substrate; a first metal layer disposed on the substrate, and the first signal wiring and the second signal wiring formed in the first metal layer; a first insulating layer disposed on the substrate and covering the first metal layer; and a second metal layer disposed on the first insulating layer, and the connecting wiring formed in the second metal layer.

Further, the first insulating layer is provided with a first via-hole and a second via-hole, the first via-hole corresponds to the first signal wiring, the second via-hole corresponds to the second signal wiring, one end of the connecting wiring is connected to the first signal wiring through the first via-hole, and the other end of the connecting wiring is connected to the second signal wiring through the second via-hole.

Further, the first signal wiring includes a clock signal wire, a voltage wire, and a restart wire.

Further, the clock signal wire and the voltage wire are connected to the GOA signal bus; and the restart wire is connected to the GOA circuit.

Further, a wire of the GOA circuit is formed in the first metal layer; the first insulating layer is further provided with a third via-hole, the third via-hole corresponds to the wire of the GOA circuit; and one end of the connecting wiring is connected to the first signal wiring through the first via-hole, and the other end of the connecting wiring is connected to the wire of the GOA circuit through the third via-hole.

Another object of the present invention is to provide a spliced display panel, including a main display panel, wherein the main display panel is the display panel described above; and at least one auxiliary display panel spliced to a narrow-area of the main display panel.

Further, a splicing distance between the main display panel and the auxiliary display panel is less than 1 mm.

BENEFICIAL EFFECT

The beneficial effects of the present invention are: By changing the traditional way that signal outputs from both sides of the chip-on-film area to a way that signal outputs from each thin-film chip to reduce signal difference in the wiring of GOA bus, such that the difference of GOA signal received by each GOA wire is reduced as much as possible, this reduces the difference in the signals output by the GOA circuit and reduces the impact on the charging of pixels in the display area DESCRIPTION OF DRAWINGS In order to more clearly describe the technical solutions in the embodiments of the present invention, the following will briefly introduce the drawings used in the description of the embodiments. Obviously, the drawings in the following description are some embodiments of the present invention. For those skilled in the art, other drawings can be obtained from these drawings without creative work.

Figure 1:
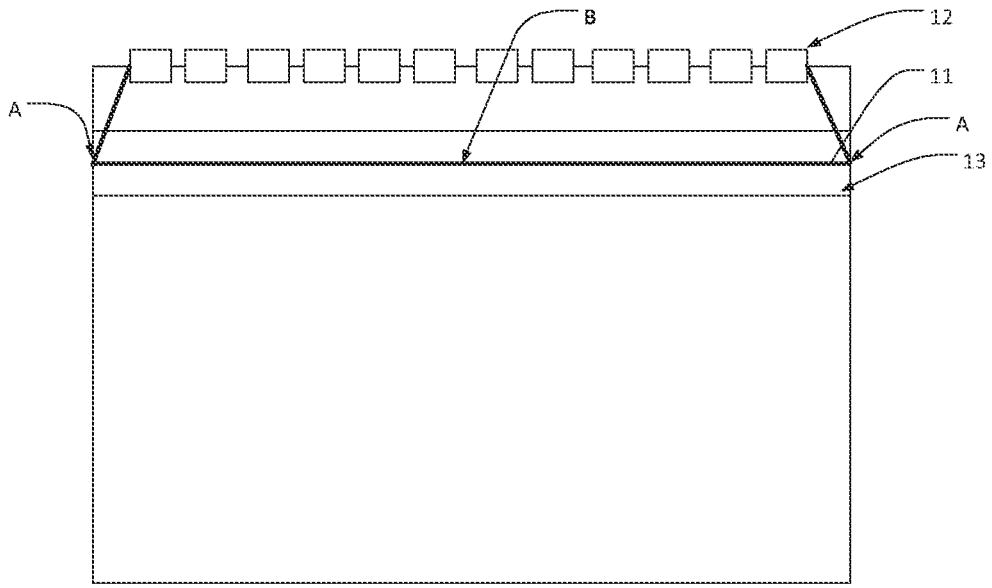
FIG. 1 is a plan view of a prior art display panel.
Figure 2:
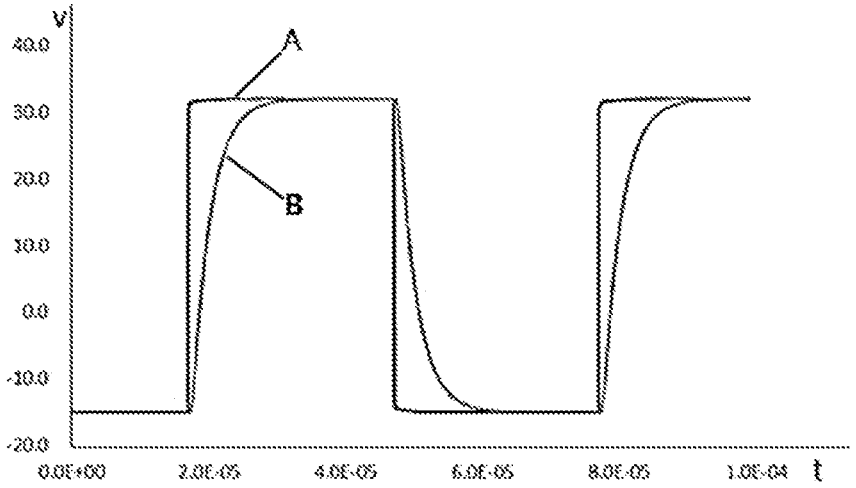
FIG. 2 is a waveform diagram of A and B positions of a GOA signal bus in the prior art.

REFERENCE NUMERALS display panel 100, main display area 110, wide-area 120, narrow-area 130, GOA circuit 101, GOA signal bus 102, chip-on-film area 103, thin-film chip 104, output terminal 105, first output terminal 1051, second output terminal 1052, first input terminal 1061, second input terminal 1062, input terminal 106, first signal wiring 1031, second signal wiring 1021, first via-hole 1032, second via-hole 1022, substrate 201, first metal layer 202, first insulating layer 203, second metal layer 204 metal wiring 21, wiring 1011 of GOA circuit, third via-hole 1012, voltage wire 108, restart wire 107, connecting wiring 22.

DETAILED DESCRIPTION OF PREFERRED EMBODIMENTS

The following description of each embodiment refers to the drawings to illustrate specific embodiments in which the present invention can be implemented. The directional terms mentioned in the present invention, such as "above", "under", "front", "back", "left", "right", "inside", "outside", "side", etc., are only directions with reference to the drawings. The component designations mentioned in the present invention, such as first, second, etc., only distinguish different components so that they can be better expressed. In the drawings, units with similar structures are indicated by the same reference numerals.

The embodiments of the present invention will be described in detail herein with reference to the accompanying drawings. The present invention can be presented in many different forms, and the present invention should not only be interpreted as the specific embodiments set forth herein. The embodiments of the present invention are provided to explain the practical application of the present invention so that other skilled in the art can understand various embodiments of the present invention and various modifications suitable for specific expected applications.

Figure 3:
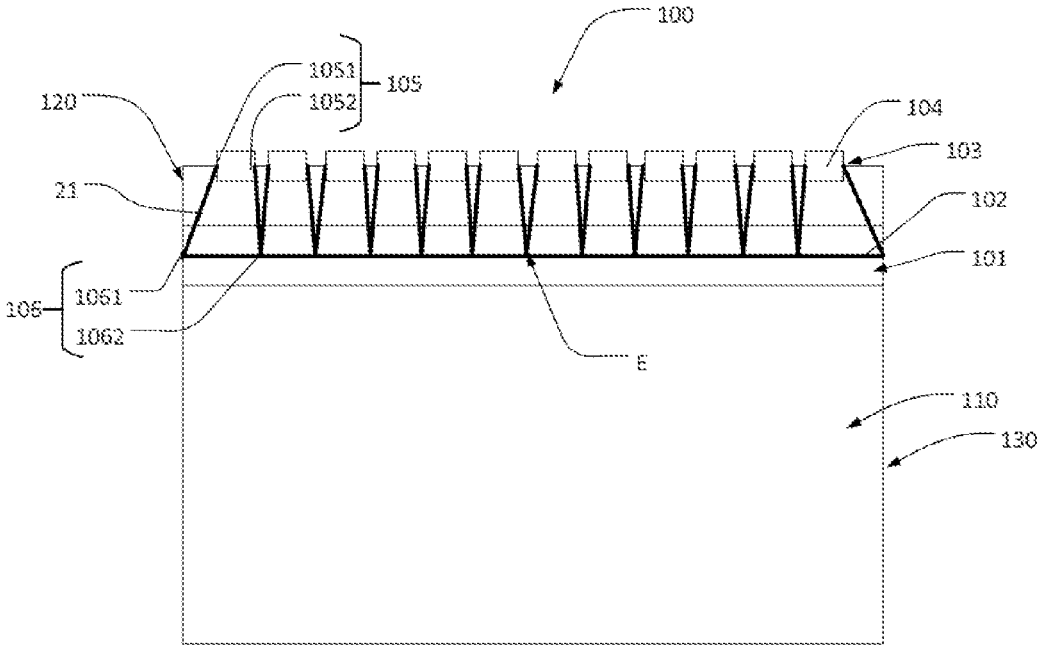
FIG. 3 is a schematic plan view of a display panel provided by the present invention.

As shown in FIG. 3, a display panel 100 includes a main display area 110 and a non-display area.

The non-display area includes one wide-area 120 and three narrow-areas 130, the one wide-area 120 and the three narrow-areas 130 surround the main display area 110, and a border width of the wide-area 120 is greater than a border width of the narrow-areas 130.

The display panel 100 is a three-narrow-one-wide product. The wide-area 120 is configured to set control circuits, and the three narrow-areas 130 are configured to carry out panel splicing.

In the non-display area, the display panel 100 further includes: a GOA circuit 101, a GOA signal bus 102, and a chip-on-film area 103.

The GOA circuit 101 is disposed in the wide-area 120 and close to the main display area 110.

The GOA signal bus 102 is disposed in the wide-area 120 in parallel with the GOA circuit 101 and connected to the GOA circuit 101.

The chip-on-film area 103 is disposed in the wide-area 120 in parallel with the GOA signal bus 102, and the GOA signal bus 102 is disposed between the GOA circuit 101 and the chip-on-film area 103.

The chip-on-film area 103 includes a plurality of thin-film chips 104 arranged in an array, each of the thin-film chips 104 is provided with at least one output terminal 105, the GOA signal bus 102 is provided with at least one input terminal 106 corresponding to each of the thin-film chips 104, and the output terminal 105 and the input terminal 106 are connected by a metal wiring 21.

The present invention changes the traditional way that signal outputs from both sides of the chip-on-film area 103 to a way that signal outputs from each thin-film chip, so as to reduce the signal difference in the wiring of GOA bus, such that the difference of GOA signal received by each GOA wiring is reduced as much as possible. This reduces the difference in the signals output by the GOA circuit 101 and reduces the impact on the charging of pixels in the display area.

The output terminal 105 includes a first output terminal 1051 and a second output terminal 1052, the first output terminal 1051 and the second output terminal 1052 are respectively disposed on both sides of the thin-film chip, the input terminal 106 includes a first input terminal 1061 and a second input terminal 1062 corresponding to the first output terminal 1051 and the second output terminal 1052.

The first output terminal 1051 and the second output terminal 1052 are respectively connected to the first input terminal 1061 and the second input terminal 1062 through the metal wiring 21.

Figure 4:
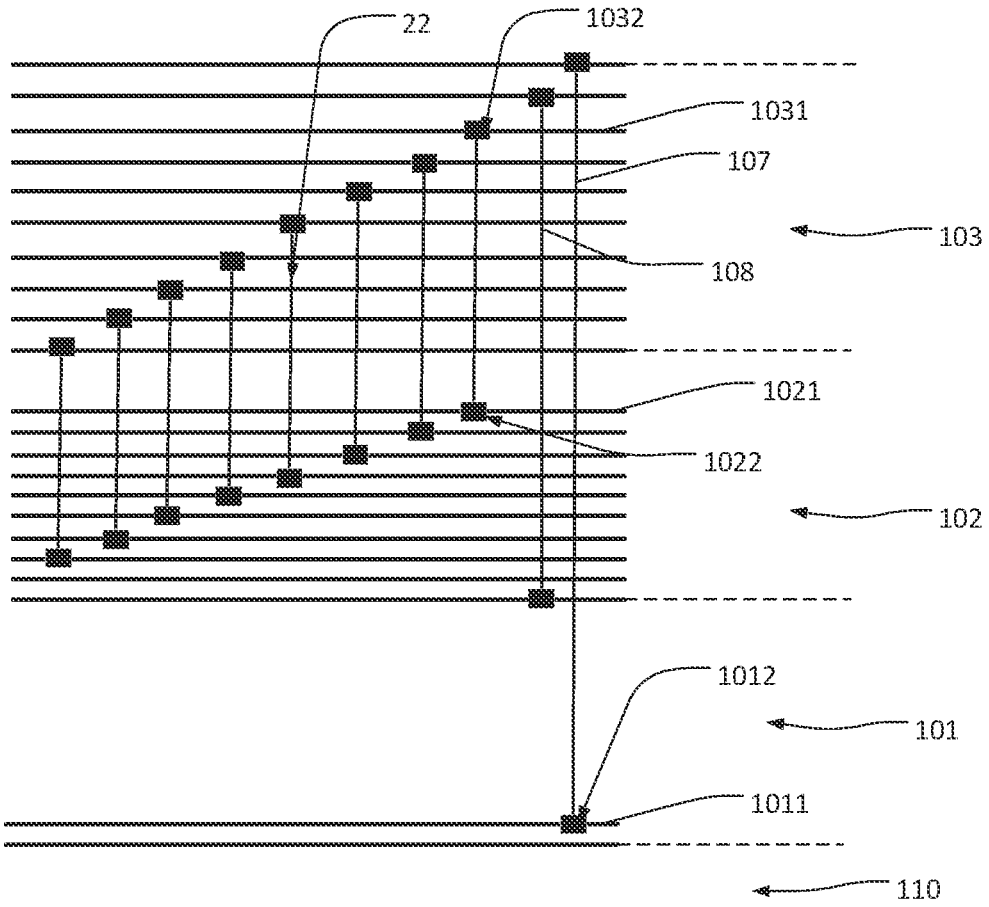
FIG. 4 is a schematic diagram of specific wiring of a connection position 140 in FIG. 3.
Figure 5:
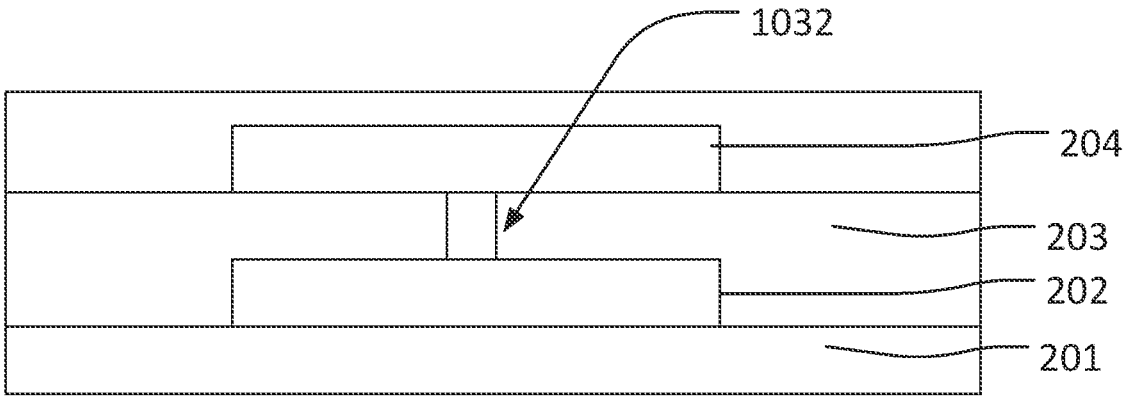
FIG. 5 is a cross-sectional view of a connecting hole shown in FIG. 4.
Figure 6:
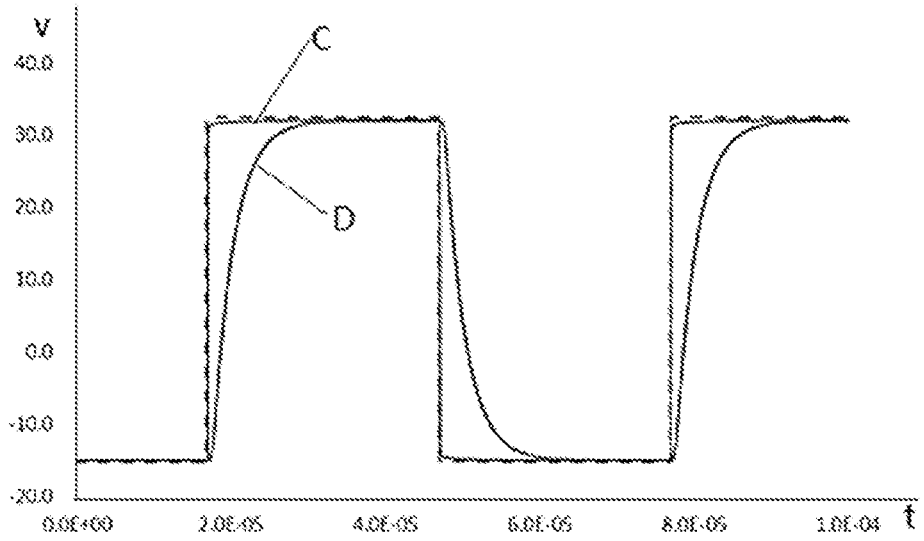
FIG. 6 is a waveform diagram of detecting GOA signal bus at E position of the present invention.

As shown in FIG. 4 and FIG. 5, in the connection area of the input terminal 106, the metal wiring 21 includes a plurality of first signal wirings 1031 arranged in parallel.

The GOA signal bus 102 includes a plurality of second signal wirings 1021 arranged in parallel, and the second signal wirings 1021 are parallel to the first signal wirings 1031.

The first signal wiring 1031 is connected to its corresponding second signal wiring 1021 through a connecting wiring 22, and the connecting wiring 22 is perpendicular to the second signal wiring 1021.

The layered structure diagram of the non-display area shown in FIG. 5 is specifically a cross-sectional view of the position of the connecting hole (first via-hole 1032, second via-hole 1022, and third via-hole 1012) in FIG. 3. In the non-display area, the display panel 100 includes a substrate 201, a first metal layer 202, a first insulating layer 203, and a second metal layer 204.

The first metal layer 202 is disposed on the substrate 201, and the first signal wiring 1031 and the second signal wiring 1021 are formed in the first metal layer 202.

The first insulating layer 203 is disposed on the substrate 201 and covers the first metal layer 202.

The second metal layer 204 is disposed on the first insulating layer 203, and the connecting wiring 22 is formed in the second metal layer.

The first insulating layer 103 is provided with a first via-hole 1032 and a second via-hole 1022, the first via-hole 1032 corresponds to the first signal wiring 1031, the second via-hole 1022 corresponds to the second signal wiring 1021, one end of the connecting wiring 22 is connected to the first signal wiring 1031 through the first via-hole 1032, and the other end of the connecting wiring 22 is connected to the second signal wiring 1021 through the second via-hole 1022.

The first signal wiring 1031 includes a clock signal wire, a voltage wire 108, and a restart wire 107. The clock signal wire and the voltage wire 108 are connected to the GOA signal bus 102.

The restart wire 107 is connected to the GOA circuit 101.

A wire of the GOA circuit 101 is formed in the first metal layer 202.

The first insulating layer 203 is further provided with a third via-hole 1012, the third via-hole 1012 corresponds to the wire of the GOA circuit 101.

One end of the connecting wiring 22 is connected to the first signal wiring 1031 through the first via-hole 1032, and the other end of the connecting wiring 22 is connected to the wire 1011 of the GOA circuit through the third via-hole 1012.

As shown in FIG. 5, it is a waveform diagram of the GOA signal bus 102 detected by the present invention. It can be seen that the waveform C of the present invention is almost the same as the original signal (dotted line). However, the waveform D of the prior art has a certain difference from the original signal.

The falling time of the prior art waveform ≈5.85 us, and the falling time of the present invention ≈0.05 us, which greatly reduces the waveform difference between the far and near ends of the signal source of the GOA signal wiring.

Figure 7:
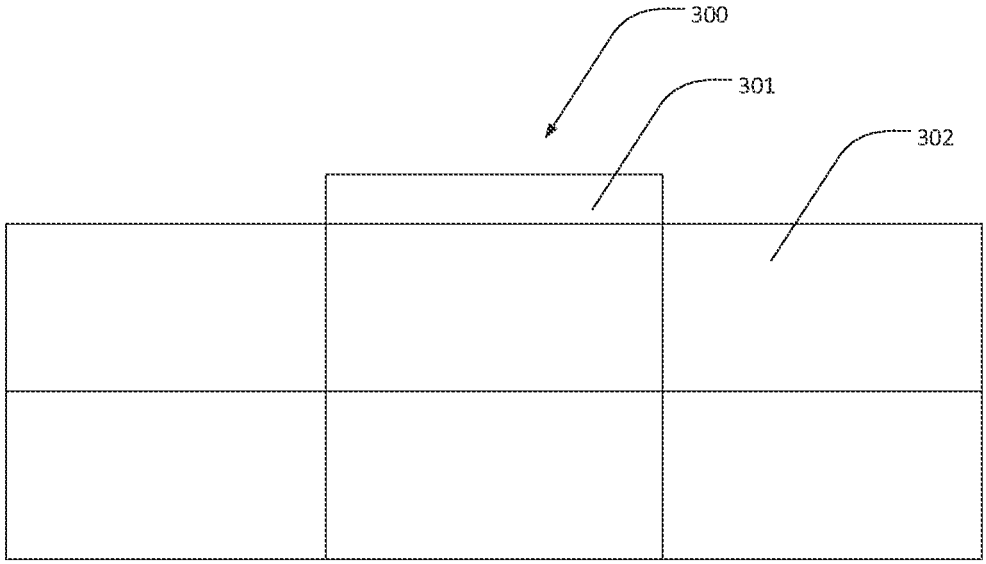
FIG. 7 is a schematic plan view of a spliced display panel provided by the present invention.

As shown in FIG. 7, the present invention also provides a spliced display panel 300, including a main display panel 301 and at least one auxiliary display panel 302.

The main display panel 301 is the display panel 100 described above.

The auxiliary display panel 302 is spliced to the narrow-area 130 of the main display panel.

The splicing distance between the main display panel 301 and the auxiliary display panel 302 is less than 1 mm.

The present invention changes the traditional way that signal outputs from both sides of the chip-on-film area 103 to a way that signal outputs from each thin-film chip 104, so as to reduce the signal difference in the wiring of GOA bus, such that the difference of GOA signal received by each GOA wiring is reduced as much as possible. This reduces the difference in the signals output by the GOA circuit 101 and reduces the impact on the charging of pixels in the display area.

In the above-mentioned embodiments, the description of each embodiment has its own emphasis. For parts that are not described in detail in an embodiment, reference may be made to related descriptions of other embodiments.

The technical scope of the present invention is not limited only to the content in the description. Those skilled in the art can make various modifications or amendments to the embodiment without departing from the technical idea of the present invention, and these modifications or amendments should fall within the scope of the present invention.

What is claimed is:

1. A display panel, comprising a main display area and a non-display area, the non-display area comprising:

a substrate;

a first metal layer disposed on the substrate, wherein first signal wirings and second signal wirings are formed in the first metal layer;

a first insulating layer disposed on the substrate and covering the first metal layer; and a second metal layer disposed on the first insulating layer, wherein connecting wirings are formed in the second metal layer;

wherein the non-display area is defined with one wide-area and three narrow-areas, the wide-area and the three narrow-areas surround the main display area, and a border width of the wide-area is greater than a border width of the narrow-areas;

wherein a GOA circuit is disposed in the wide-area and close to the main display area, a GOA signal bus is disposed in the wide-area in parallel with the GOA circuit and connected to the GOA circuit, a chip-on-film area is defined in the wide-area in parallel with the GOA signal bus, and the GOA signal bus is disposed between the GOA circuit and the chip-on-film area;

wherein the chip-on-film area is provided with a plurality of thin-film chips arranged in an array, each of the thin-film chips is provided with at least one output terminal, the GOA signal bus is provided with at least one input terminal corresponding to each of the thin film chips, and the output terminal and the input terminal are connected by a metal wiring;

wherein the metal wiring comprises the first signal wirings arranged in parallel, the GOA signal bus comprises the second signal wirings arranged in parallel, and the second signal wirings are parallel to the first signal wirings; and wherein each first signal wiring is connected to a corresponding second signal wiring through one of the connecting wirings, and the connecting wirings are perpendicular to the second signal wirings.

2. The display panel of claim 1, wherein the output terminal comprises a first output terminal and a second output terminal, the first output terminal and the second output terminal are respectively disposed on both sides of the thin film chips, the input terminal comprises a first input terminal and a second input terminal corresponding to the first output terminal and the second output terminal, and the first output terminal and the second output terminal are respectively connected to the first input terminal and the second input terminal through the metal wiring.

3. The display panel of claim 1, wherein the first insulating layer is defined with a first via-hole and a second via-hole, the first via-hole corresponds to the first signal wirings, the second via-hole corresponds to the second signal wirings, one end of one of the connecting wirings is connected to the first signal wirings through the first via-hole, and another end of the connecting wiring is connected to the second signal wirings through the second via-hole.

4. The display panel of claim 1, wherein the first signal wirings comprise a clock signal wire, a voltage wire, and a restart wire.

5. The display panel of claim 4, wherein the clock signal wire and the voltage wire are connected to the GOA signal bus, and the restart wire is connected to the GOA circuit.

6. The display panel of claim 3, wherein a wire of the GOA circuit is formed in the first metal layer, the first insulating layer is further provided with a third via-hole, the third via-hole corresponds to the wire of the GOA circuit, and one end of the connecting wiring is connected to the first signal wirings through the first via-hole, and the other end of the connecting wiring is connected to the wire of the GOA circuit through the third via-hole.

7. A spliced display panel, comprising:

a main display panel, the main display panel being the display panel of claim 1; and at least one auxiliary display panel spliced to the narrow-area of the main display panel.

8. The spliced display panel of claim 7, wherein a splicing distance between the main display panel and the auxiliary display panel is less than 1 mm.

* * * * *